US012590758B2

(12) United States Patent
Hirose et al.

(10) Patent No.: US 12,590,758 B2
(45) Date of Patent: Mar. 31, 2026

(54) NITROGEN GENERATING DEVICE AND NITROGEN GENERATING METHOD

(71) Applicant: L'Air Liquide, Societe Anonyme pour l'Etude et l'Exploitation des Procedes Georges Claude, Paris (FR)

(72) Inventors: Kenji Hirose, Kobe (JP); Daisuke Nagata, Kobe (JP)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 287 days.

(21) Appl. No.: 18/134,758

(22) Filed: Apr. 14, 2023

(65) Prior Publication Data

US 2023/0341181 A1 Oct. 26, 2023

(30) Foreign Application Priority Data

Apr. 15, 2022 (JP) ..... 2022-067344

(51) Int. Cl.
*F25J 3/04* (2006.01)

(52) U.S. Cl.
CPC ..... *F25J 3/04781* (2013.01); *F25J 3/04018* (2013.01); *F25J 3/04066* (2013.01); *F25J 3/04284* (2013.01); *F25J 3/044* (2013.01); *F25J 2215/42* (2013.01); *F25J 2230/30* (2013.01); *F25J 2245/40* (2013.01); *F25J 2280/00* (2013.01)

(58) Field of Classification Search
CPC .. F25J 3/04066; F25J 3/04284; F25J 3/04781; F25J 3/044; F25J 2245/50; F25J 2280/02; F25J 2230/50; F25J 2230/52; F25J 2240/20; F25J 2240/22
See application file for complete search history.

(56) References Cited

U.S. PATENT DOCUMENTS

| | | | | | |
|---|---|---|---|---|---|
| 4,222,756 | A | | 9/1980 | Thorogood | |
| 4,966,002 | A | * | 10/1990 | Parker | F25J 3/04242 62/647 |
| 5,170,630 | A | * | 12/1992 | Stern | F25J 3/04333 62/643 |
| 5,363,657 | A | * | 11/1994 | Naumovitz | F25J 3/04066 62/651 |

(Continued)

FOREIGN PATENT DOCUMENTS

| | | | | | |
|---|---|---|---|---|---|
| CS | 254251 | B1 | * | 12/1982 | |
| JP | 2004116802 | A | * | 4/2004 | F25J 3/04284 |
| JP | 2004198016 | A | * | 7/2004 | F25J 3/0426 |

*Primary Examiner* — John F Pettitt, III
(74) *Attorney, Agent, or Firm* — Justin K. Murray

(57) ABSTRACT

A nitrogen generating device comprises: a main heat exchanger; a nitrogen distillation column; at least one nitrogen condenser; a compressor; an expansion turbine; a rotation control unit for controlling rotation with respect to a rotating shaft connecting the compressor and the expansion turbine; a pressure measuring unit for measuring a pressure value of product nitrogen gas; and an optimum rotational speed calculation command unit which inputs the pressure value measured by the pressure measuring unit into a pre-installed rotational speed calculation function to calculate the rotational speed of the rotating shaft, and issues a command to the rotation control unit.

7 Claims, 4 Drawing Sheets

(56) References Cited

U.S. PATENT DOCUMENTS

| | | | | |
|---|---|---|---|---|
| 5,582,034 | A * | 12/1996 | Naumovitz | F25J 3/04321 62/652 |
| 5,711,167 | A | 1/1998 | Ha et al. | |
| 5,924,307 | A * | 7/1999 | Nenov | F25J 3/04133 62/643 |
| 6,273,936 | B1 * | 8/2001 | Barry | F25J 3/04793 96/111 |
| 2012/0144861 | A1 * | 6/2012 | Tomita | F25J 3/04212 62/643 |
| 2019/0293348 | A1 * | 9/2019 | Hirose | F25J 1/0032 |
| 2020/0182543 | A1 * | 6/2020 | Hirose | F25J 3/0443 |
| 2021/0381761 | A1 * | 12/2021 | Kunz | F25J 3/04048 |

* cited by examiner

NITROGEN GENERATING DEVICE AND NITROGEN GENERATING METHOD

CROSS REFERENCE TO RELATED APPLICATIONS

This application claims the benefit of priority under 35 U.S.C. § 119 (a) and (b) to Japanese patent application No. JP2022-067344, filed Apr. 15, 2022, the entire contents of which are incorporated herein by reference.

FIELD OF THE INVENTION

The present disclosure relates to a nitrogen generating device and a nitrogen generating method for generating nitrogen from feed air.

BACKGROUND OF THE INVENTION

Nitrogen generating devices employing cryogenic air separation are suitable for high-volume production of high-purity nitrogen. Such nitrogen generating devices are applied to inert gas supply or nitrogen feedstock supply for ammonia synthesis and the like. Nitrogen generating devices include single-column rectification type devices (patent literature article 1, for example) provided with only one distillation column, and multiple-column rectification type devices (patent literature article 2, for example) provided with two or more distillation columns.

The optimum pressure of the product nitrogen gas supply pressure varies in accordance with the nitrogen gas utilization status at the supply destination. With a multiple-column rectification type device, since the product nitrogen gas is supplied from a low pressure distillation column, the product nitrogen gas is compressed to the supply pressure by means of a product nitrogen compressor, and therefore the pressure can be optimized in accordance with demand pressure changes by means of discharge pressure control of the product nitrogen compressor. Meanwhile, in the case of a single-column rectification type device, nitrogen gas can be supplied without the use of a nitrogen compressor by operating the distillation column at a pressure necessary to supply the product nitrogen gas. However, if one tries to follow changes in the supply destination demand pressure, the operating pressure of the distillation column must be varied with each change. A change in the operating pressure of the distillation column necessitates an operation such as varying a discharge pressure control value of a feed air compressor, for example, in order to increase the feed air pressure to match the change.

[Patent Document 1] U.S. Pat. No. 5,711,167

[Patent Document 2] U.S. Pat. No. 4,222,756

SUMMARY OF THE INVENTION

In the case of the nitrogen generating device provided with a cold booster expander described in document 1, since the operating pressure of a nitrogen condenser also changes in conjunction with a change in the operating pressure of the distillation column, the operating pressure conditions of the booster expander change. Furthermore, since the operating pressure of the distillation column also affects the nitrogen separation efficiency, the nitrogen recovery rate is also affected as a result, and a processing flow rate of the booster expander must also be controlled in order to maintain the production quantity of product nitrogen gas. However, it is complex and costly to successively calculate and study the balance between process pressure and flow rate, and to reset the control values, in accordance with an arbitrarily defined supply pressure, and is therefore impractical. As a result, even in a case in which the product nitrogen gas can be supplied at a relatively low pressure, the product nitrogen gas supply pressure from the nitrogen generating device remains set at the maximum value of the expected demand pressure, and as a result, a difference between the demand pressure and the supply pressure results in an energy loss.

The objective of certain embodiments of the present invention is to provide a nitrogen generating device and a nitrogen generating method with which it is possible to control a compressor (booster) and an expansion turbine (expander) more efficiently than in the past, in accordance with changes in the product nitrogen gas supply pressure.

As a result of intensive investigations carried out by the inventors of the present invention using simulations and actual equipment, it became apparent that if the amount of product nitrogen gas is kept constant, there is a positive correlation between the operating pressure of the distillation column and the rotational speed of the booster expander.

Table 1 shows the optimal booster operating condition at each product nitrogen gas pressure for a case in which feed air is introduced at 27,300 $Nm^3/h$ and product nitrogen gas is generated at 17,000 $Nm^3/h$.

TABLE 1

| Product nitrogen gas pressure (barG) | 8.8 | 9 | 9.2 |
|---|---|---|---|
| Recycled air molar flow rate ($Nm^3/h$) | 13822 | 14130 | 14438 |
| Recycled air pressure at booster intake (barA) | 4.76 | 4.88 | 5.00 |
| Recycled air intake temperature at booster intake (° C.) | −170.9 | −170.6 | −170.3 |
| Recycled air density at booster intake ($kg/m^3$) | 22.9 | 23.4 | 23.8 |
| Recycled air volumetric flow rate ($m^3/h$) | 792 | 794 | 796 |

The optimum recycled air molar flow rate increases as the product nitrogen gas pressure increases. This is because the distillation efficiency decreases as the operating pressure of the distillation column increases, and it is therefore necessary to increase vapor flow to maintain the purity of the product nitrogen gas. The recycled air generation source is an oxygen-enriched liquid that evaporates by exchanging heat with nitrogen gas in an upper portion of the distillation column, but since the temperature of the recycled air at the booster intake is a temperature that is lower than the nitrogen gas condensation point by the temperature difference in the nitrogen condenser, and the recycled air pressure is an equilibrium pressure at that temperature, the temperature and pressure of the recycled air at the booster intake increase by an amount corresponding to the increase in the pressure of the product nitrogen gas. By summarizing the molar flow rate of the recycled air and the temperature and pressure at the booster intake, and performing an evaluation using the volumetric flow rate, it was found that the recycled air volumetric flow rate increases in proportion to an increase in the nitrogen gas pressure. This makes it possible to infer the optimum booster expander rotational speed by employing a function that takes the pressure of the distillation column as a variable, and enables the process balance to be optimized without performing a complex study.

This can be interpreted in principle as follows. Since the distillation column recovery rate decreases when the distillation column pressure increases, the amount of feed air or recycled air must be increased in order to maintain the amount of product nitrogen gas, but increasing the amount of feed air is contrary to a reduction in energy consumption, and it is therefore preferable to increase the amount of recycled air. The amount of recycled air in the booster expander is determined by the sum of a volumetric flow rate processing capability of an impeller of the booster, and the rotational speed of a rotating shaft of the booster. Since the structure of the impeller is non-varying in operation under process conditions, rotational speed control is essential.

Since the optimum recycled air at each process pressure is not obvious, studies were conducted using a fixed pressure range in the same device, which included a distillation column and a booster expander, as a result of which it was possible to find a positive correlation (correlation represented by a linear or non-linear polynomial expression) between the distillation column pressure and the volumetric flow rate of the recycled air, that could easily be reproduced using a polynomial expression. In other words, since the volumetric flow rate of the recycled air can be calculated as the sum of the volumetric flow rate processing capability and the rotational speed of the impeller, as discussed hereinabove, it was clear that the optimum recycled air volumetric flow rate and a rotational speed set value of the booster expander can be determined using a function that takes the distillation column pressure as a variable, and that a control point of the booster expander can be determined.

The following formula (1) was found as a rotational speed calculation function for expressing the positive correlation (linear correlation).

$$y=a\times x+b \tag{1}$$

Rotational speed set value: y

Coefficient: a

Product nitrogen gas pressure (pressure in pipeline upstream or downstream of heat exchanger, pressure at arbitrarily defined location in nitrogen distillation column): x Correction value: b Further, the following formula (2) was found as a calculation function for obtaining a feed air pressure set value $$z=d\times x+e \tag{2}$$

Feed air pressure set value: z

Coefficient: d

Product nitrogen gas pressure: x

Correction value: e

Further, it was found to use the following formula (3) to adjust the rotational speed set value obtained using the rotational speed calculation function.

$$y'=w\times Y \tag{3}$$

Rotational speed set value after adjustment: y'

Rotational speed set value: y

Coefficient: w (flow rate value of product nitrogen gas)

Each coefficient and correction value are set from the results of simulations corresponding to the equipment specifications of the device.

A non-linear function may be used as the rotational speed calculation function. Formula 11 is one such example.

$$y=a_1\times x+a_2\times x^2+a_3\times x^3+b_1 \tag{11}$$

Rotational speed set value: y

Coefficients: $a_1$, $a_2$, $a_3$

Product nitrogen gas pressure (pressure in pipeline upstream or downstream of heat exchanger, pressure at arbitrarily defined location in nitrogen distillation column): x Correction value: $b_1$ Further, the following formula (12) was found as a calculation function for obtaining the feed air pressure set value $$z=d\times x+e \tag{12}$$

Feed air pressure set value: z

Coefficient: d

Product nitrogen gas pressure (pressure in pipeline upstream or downstream of heat exchanger, pressure at arbitrarily defined location in nitrogen distillation column): x Correction value: e Further, it was found to use the following formula (13) to adjust the rotational speed set value obtained using the rotational speed calculation function.

$$y'=w\times y \tag{13}$$

Rotational speed set value after adjustment: y'

Rotational speed set value: y

Coefficient: w (flow rate value of product nitrogen gas)

Each coefficient and correction value are set from the results of simulations corresponding to the equipment specifications of the device.

The nitrogen generating device according to the present disclosure has a configuration in which feed air is introduced from a lower portion of a distillation column and high-purity nitrogen is discharged from an upper portion thereof and can be extracted as product nitrogen gas.

A nitrogen generating device (100) according to the present disclosure comprises: a main heat exchanger (1) into which feed air is introduced; a nitrogen distillation column (2) having a lower portion (22) into which the feed air discharged from the main heat exchanger (1) is introduced; at least one nitrogen condenser (first nitrogen condenser (3), second nitrogen condenser (4)) for condensing the nitrogen gas discharged from a column top portion (24) of the nitrogen distillation column (2); a compressor (6) into which first gas discharged from column top portions (32, 42) of the nitrogen condensers (3, 4) is introduced; a first gas recycling pipeline (L42) for causing the first gas compressed by the compressor (6) to pass through a portion of the main heat exchanger (1) and for introducing the same into the lower portion of the nitrogen distillation column (2); an expansion turbine (7) into which second gas discharged from the column top portions (32, 42) of the nitrogen condensers (3, 4) is introduced after passing through a portion of the main heat exchanger (1); a second gas discharge pipeline (L32) for causing the second gas used by the expansion turbine (7) to pass through the main heat exchanger (1) and be expelled; a rotation control unit (oil brake (8)) for controlling rotation with respect to a rotating shaft connecting the compressor (6) and the expansion turbine (7); a product nitrogen gas extraction pipeline (L24) for causing the nitrogen gas discharged from the column top portion (24) or an upper distillation portion (23) of the nitrogen distillation column (2) to pass through the main heat exchanger (1), and for then extracting product nitrogen gas; a pressure measuring unit (91) for measuring a pressure value in an arbitrarily defined part of the nitrogen distillation column or measuring a pressure value of the product nitrogen gas; and an optimum rotational speed calculation command unit (9) for using the pressure value measured by the pressure measuring unit in a pre-installed rotational speed calculation function to calculate a rotational speed of the rotating shaft, and for issuing a command to the rotation control unit (8).

The pressure measuring unit (91) may be provided on an upstream side or a downstream side of the main heat exchanger (1) in the product nitrogen gas extraction pipeline (L24) to measure the pressure value of the product nitrogen gas.

The pressure measuring unit (91) may measure the pressure value at an arbitrarily defined location in the column top portion, distillation portion, or bottom portion of the nitrogen distillation column.

The compressor (6) and the expansion turbine (7) may be configured using a booster expander or an expansion turbine integrated-type compressor provided with an oil brake, for example. Further, the booster expander may be provided with a control nozzle or bypass.

The optimum rotational speed calculation command unit (9) may control a flow rate control valve (94) provided in an oil introduction pipeline for supplying oil to the rotation control unit (oil brake (8)), to control the amount of oil that is supplied. A rotation angle measuring unit (93) for measuring a rotation angle of a motor of the flow rate control valve (94) may be provided. The optimum rotational speed calculation command unit (9) may read the rotation angle measured by the rotation angle measuring unit (93) and perform control (feedback control) such that the rotational speed obtained by the rotational speed calculation function is achieved.

The nitrogen generating device (100) may be provided with a rotation measuring unit (92) for measuring the rotational speed of the rotating shaft, wherein the optimum rotational speed calculation command unit (9) and/or the rotation control unit (8) may control (feedback control) the rotational speed measured by the rotation measuring unit (92) so as to become the rotational speed obtained by the rotational speed calculation function.

The nitrogen generating device (100) may be provided with a feed air compressor (5) for controlling the supply pressure of the feed air upstream of the main heat exchanger (1), and a feed air supply pressure control unit (95) for controlling a discharge pressure set value of the feed air compressor (5) on the basis of a demand pressure value of the product nitrogen gas or a pressure value measured by the pressure measuring unit (91).

In the nitrogen generating device (100), a liquid level measuring unit (211) for measuring an amount of oxygen-enriched liquid in a bottom portion (21) of the nitrogen distillation column (2), and the optimum rotational speed calculation command unit (9) and/or the rotation control unit (8) may restrict the rotational speed such that a liquid amount measured by the liquid level measuring unit (211) lies within a predetermined set range (upper limit and lower limit values).

The nitrogen generating device (100) may be provided with: a flow rate measuring unit (97) which is provided on the upstream side or the downstream side of the main heat exchanger (1) in the product nitrogen gas extraction pipeline (L24) to measure a flow rate value of the product nitrogen gas, wherein the optimum rotational speed calculation command unit (9) may adjust the rotational speed obtained by the rotational speed calculation function in accordance with the flow rate measured by the flow rate measuring unit (97).

The nitrogen distillation column (2) and other distillation columns (not shown) may be provided with pressure gauges, temperature gauges and the like.

The product nitrogen gas extraction pipeline (L24), a circulating pipeline (L21), the first gas recycling pipeline (L42), the second gas discharge pipeline (L32), and various other pipelines may be provided with gate valves, flow rate control valves, expansion valves, and the like.

The product nitrogen gas extraction pipeline (L24), the circulating pipeline (L21), the first gas recycling pipeline (L42), the second gas discharge pipeline (L32), and various other pipelines may be provided with flowmeters, pressure gauges, temperature gauges, and the like.

The nitrogen generating method according to the present disclosure is a method for generating nitrogen with at least a main heat exchanger, a nitrogen distillation column, at least one nitrogen condenser, a compressor, and an expansion turbine, the method including: a rotation control step for controlling rotation with respect to a rotating shaft connecting the compressor and the expansion turbine; a pressure measuring step for measuring a pressure value in an arbitrarily defined part of the nitrogen distillation column or measuring a pressure value of product nitrogen gas; and an optimum rotational speed calculation command step for using the pressure value measured in the pressure measuring step in a pre-installed rotational speed calculation function to calculate a rotational speed of the rotating shaft connecting the compressor and the expansion turbine, and for issuing a command for the rotation control step.

Feed air discharged from the main heat exchanger may be introduced into a lower portion of the nitrogen distillation column.

The nitrogen condenser may condense the nitrogen gas discharged from a column top portion of the nitrogen distillation column.

First gas discharged from the column top portion of the nitrogen condenser may be introduced into the compressor.

Second gas discharged from the column top portion of the nitrogen condenser may be introduced into the expansion turbine after passing through a portion of the main heat exchanger.

The rotation control step may be executed by means of a rotation control unit for controlling the rotation with respect to the rotating shaft connecting the compressor and the expansion turbine.

The pressure measuring step may be executed by means of a pressure measuring unit for measuring a pressure value in an arbitrarily defined part of the nitrogen distillation column or measuring a pressure value of the product nitrogen gas.

The optimum rotational speed calculation command step may be executed by means of an optimum rotational speed calculation command unit for using the pressure value measured by the pressure measuring unit in a pre-installed rotational speed calculation function to calculate the rotational speed of the rotating shaft, and for issuing a command to the rotation control unit.

BRIEF DESCRIPTION OF THE DRAWINGS

Further developments, advantages and possible applications of the invention can also be taken from the following description of the drawing and the exemplary embodiments. All features described and/or illustrated form the subject-matter of the invention per se or in any combination, independent of their inclusion in the claims or their back-references.

DETAILED DESCRIPTION OF THE INVENTION

Several embodiments of the present invention will be described below. The embodiments described below are examples of the present invention. The present invention is in no way limited by the following embodiments, and also includes a number of variant modes which are implemented within a scope that does not alter the gist of the present invention. It should be noted that not all the configurations described below are necessarily essential configurations of the present invention.

Definition of Technical Terms

In this specification, "upstream" and "downstream" are based on a flow of gas (for example, feed air, first gas, second gas, nitrogen gas).

In the specification, "pressure value in an arbitrarily defined part of the nitrogen distillation column" means, for example, a pressure value in a column top portion of the nitrogen distillation column, or in a distillation portion or bottom portion of the nitrogen distillation column.

Embodiment 1

Figure 1:
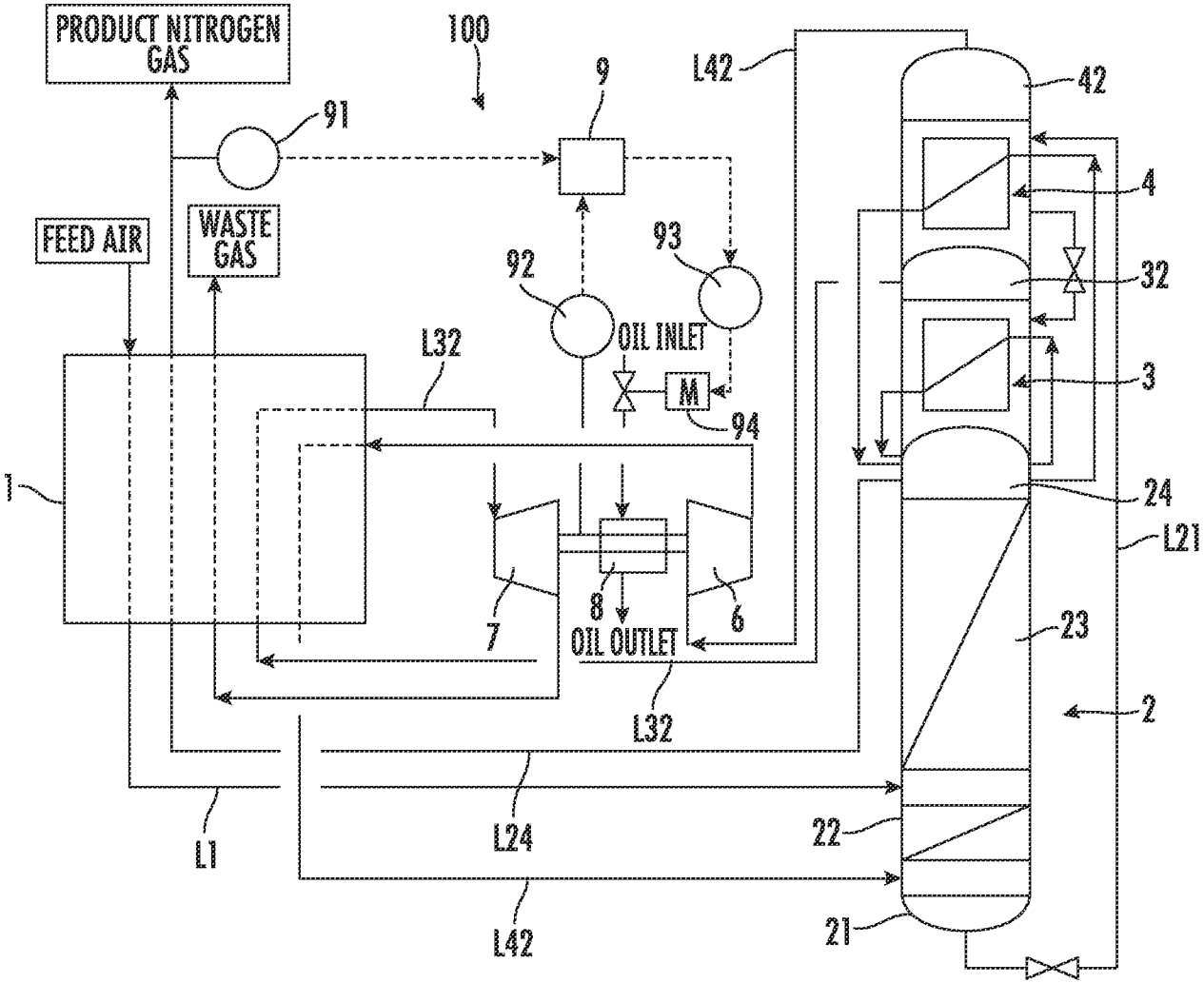
FIG. 1 is a configuration example of a nitrogen generating device (air separating device) according to embodiment 1.

A nitrogen generating device 100 of embodiment 1 illustrated in FIG. 1 is a single-column rectification type air separating device.

The nitrogen generating device 100 comprises, as a basic configuration, a main heat exchanger 1, a nitrogen distillation column 2, a first nitrogen condenser 3, a second nitrogen condenser 4, a recycled gas compressor 6, and an expansion turbine 7.

The main heat exchanger 1 exchanges heat between feed air and another gas. The feed air discharged from the main heat exchanger 1 is introduced into a lower portion 22 of the nitrogen distillation column 2. The nitrogen distillation column 2 includes a bottom portion 21, a lower distillation portion 22, an upper distillation portion 23, and a column top portion 24. Nitrogen gas discharged from the column top portion 24 of the nitrogen distillation column 2 is sent to both the first nitrogen condenser 3 and the second nitrogen condenser 4, is cooled by means of cold energy of an oxygen-enriched liquid, and then returns to the nitrogen distillation column 2. The oxygen-enriched liquid discharged from the bottom portion 21 of the nitrogen distillation column 2 is introduced via a circulating pipeline L21 into the second condenser 4 to be utilized as a cold energy source, and is sent from the second condenser 4 to the first condenser 3 to be utilized as a cold energy source.

In the present embodiment, the recycled gas compressor 6 and the expansion turbine 7 are interlocked using a common rotating shaft, and are configured as a booster expander provided with an oil brake 8 for braking the rotating shaft. The oil brake 8 has a function (rotation control function) of controlling the rotation with respect to the rotating shaft.

A second gas discharged from a column top portion 32 of the first nitrogen condenser 3 passes via a second gas discharge pipeline L32 through a portion of the main heat exchanger 1, is then sent to the expansion turbine 7 and is utilized, and then passes through the main heat exchanger 1 again and is expelled as waste gas.

A first gas (recycled gas) discharged from a column top portion 42 of the second nitrogen condenser 4 is sent via a first gas recycling pipeline L42 to the recycled gas compressor 6 to be compressed, then passes through a portion of the main heat exchanger 1 and is sent to the lower distillation portion 22 of the nitrogen distillation column 2.

Nitrogen gas discharged from the column top portion 24 or the upper distillation portion 23 of the nitrogen distillation column 2 is sent via a product nitrogen gas extraction pipeline L24 to the main heat exchanger 1 for heat exchange, and is then supplied as product nitrogen gas to a supply point.

A pressure measuring unit 91 is provided on the downstream side of the main heat exchanger 1 in the product nitrogen gas extraction pipeline L24 to measure a pressure value of the product nitrogen gas. Furthermore, an optimum rotational speed calculation command unit 9 inputs the pressure value measured by the pressure measuring unit 91 into a pre-installed rotational speed calculation function to calculate the rotational speed of the rotating shaft of the booster expander, and issues a command to the oil brake 8. In the present embodiment, the optimum rotational speed calculation command unit 9 controls a flow rate control valve 94 provided in an oil introduction pipeline for supplying oil to the oil brake 8, to control the amount of oil that is supplied. A rotation angle measuring unit 93 for measuring a rotation angle of a motor of the flow rate control valve 94 is provided, and the optimum rotational speed calculation command unit 9 reads the rotation angle measured by the rotation angle measuring unit 93 and performs control (feedback control) such that the rotational speed obtained by the rotational speed calculation function is achieved.

As another embodiment, the pressure measuring unit 91 may be provided on the upstream side of the main heat exchanger 1 in the product nitrogen gas extraction pipeline L24 to measure the pressure value of the product nitrogen gas, and may measure the pressure value in an arbitrarily defined part of the column top portion or the distillation portion of the nitrogen distillation column 2.

The rotational speed calculation function is stored in a memory, which is not shown in the drawings.

In the present embodiment, the rotational speed calculation function is the following formula (1).

$$y=a\times x+b \tag{1}$$

Rotational speed set value: y

Coefficient: a

Product nitrogen gas pressure: x

Correction value: b

The coefficient a and the correction value b are set in advance from the results of simulations corresponding to the equipment specifications and from device implementation experiments. The rotational speed calculation function is not limited to formula (1), and may be a polynomial expression of a non-linear function, set in accordance with the device specifications.

Embodiment 2

Figure 2:
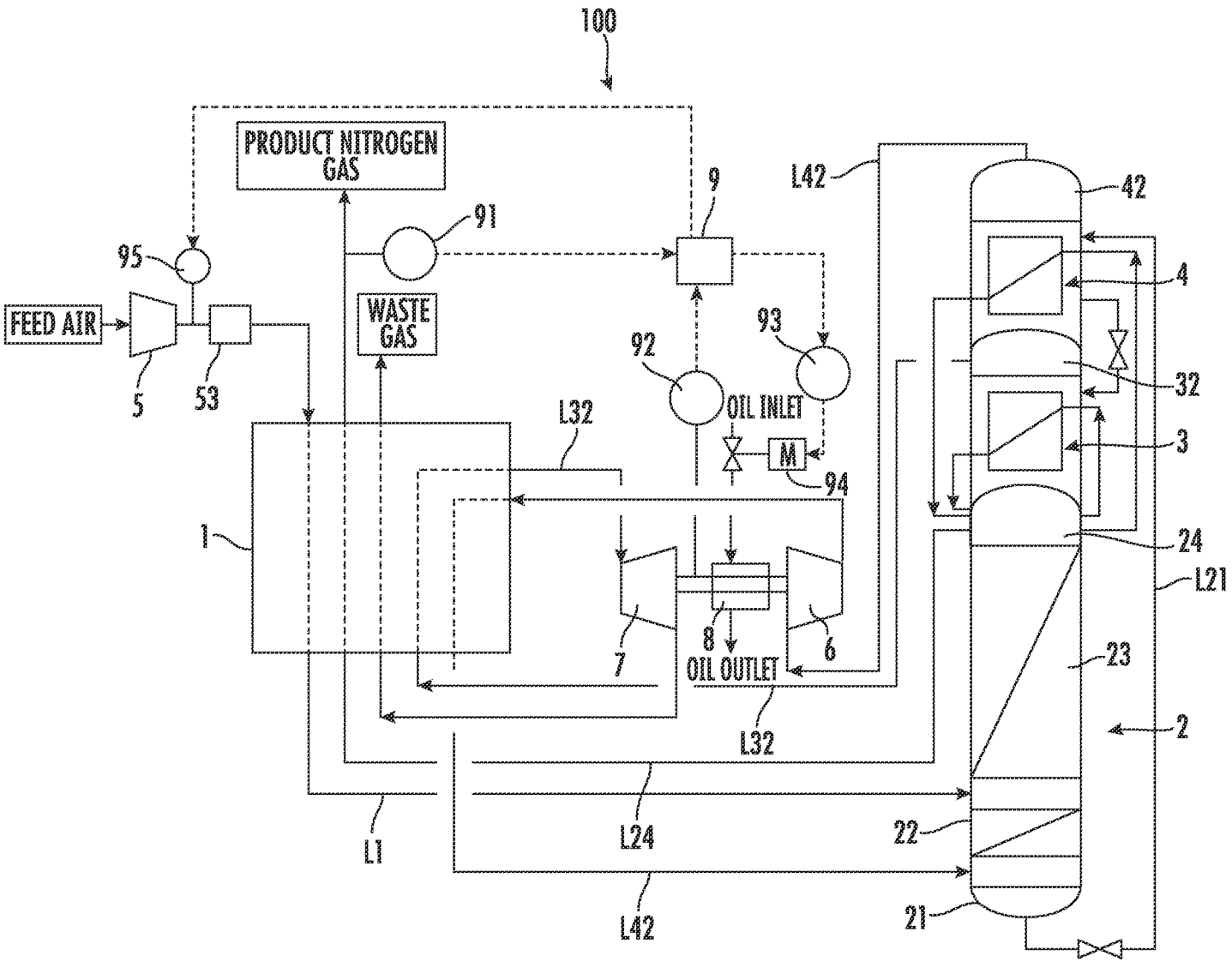
FIG. 2 is a configuration example of a nitrogen generating device (air separating device) according to embodiment 2.

The nitrogen generating device 100 according to embodiment 2 illustrated in FIG. 2 is provided with a feed air compressor 5, in addition to the configuration of embodiment 1. The same component reference numbers indicate the same functions, and components having additional functions will, in particular, be described.

The feed air compressor 5 controls the supply pressure of the feed air upstream of the main heat exchanger 1. A feed air supply pressure control unit 95 controls a discharge pressure set value of the feed air compressor 5 on the basis of a demand pressure value of the product nitrogen gas or a pressure value measured by the pressure measuring unit 91.

In the present embodiment, the feed air supply pressure can be optimized in accordance with the product nitrogen gas pressure, allowing the energy consumption related to feed air compression to be optimized. Specifically, power applied to the feed air compressor 5 is adjusted by changing the discharge pressure set value of the feed air compressor 5, for example. An air cleaning device (53) may be provided between the feed air compressor 5 and the main heat exchanger 1.

The optimum rotational speed calculation command unit 9 or the feed air supply pressure control unit 95 may obtain the discharge pressure set value. The discharge pressure set value may be obtained using the following arithmetic expression (2).

$$z=d\times x+e \quad (2)$$

Feed air pressure set value: z
Coefficient: d
Product nitrogen gas pressure: x
Correction value: e The coefficient d and the correction value e are set in advance from the results of simulations corresponding to the equipment specifications and from device implementation experiments.

Embodiment 3

Figure 3:
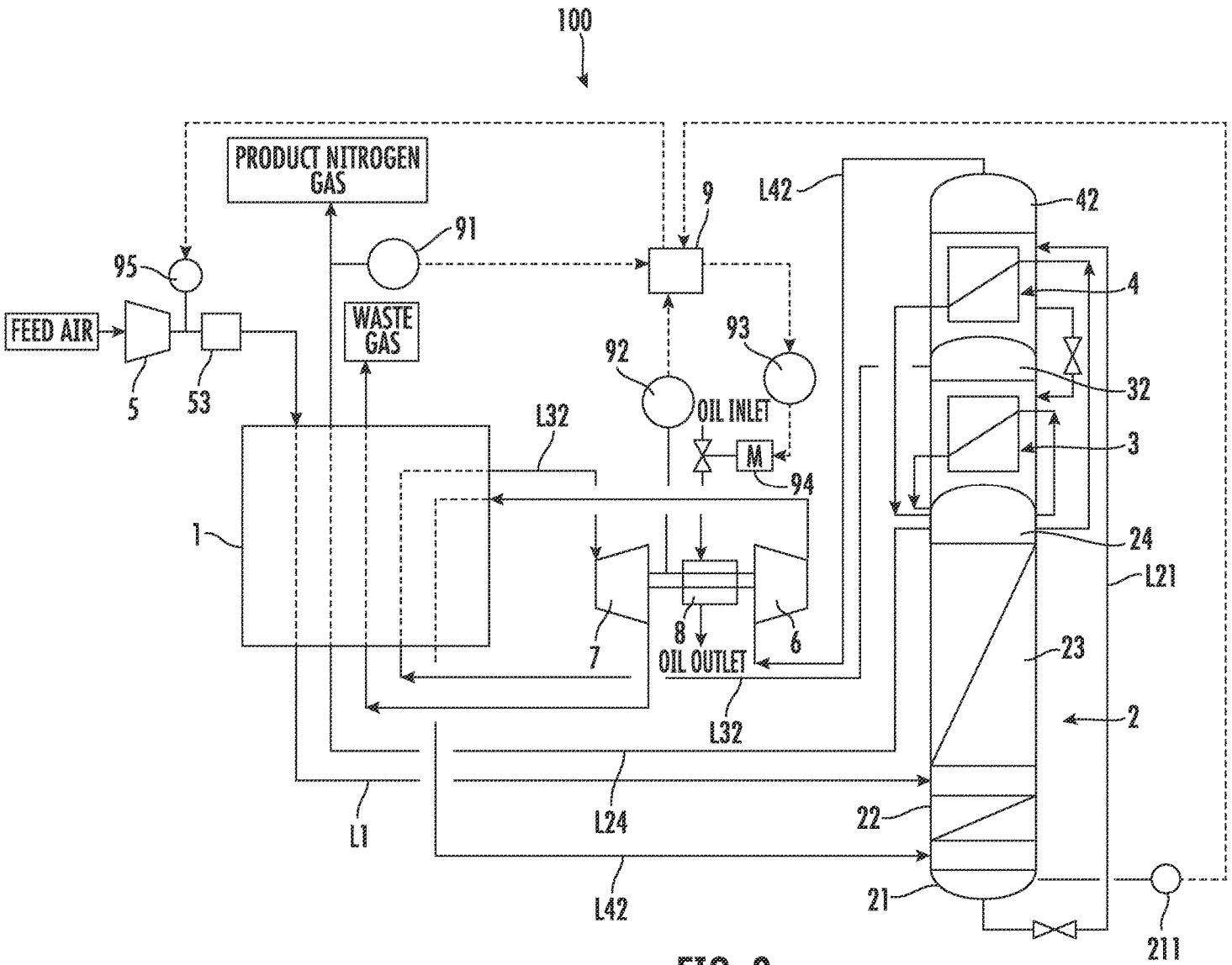
FIG. 3 is a configuration example of a nitrogen generating device (air separating device) according to embodiment 3.

The nitrogen generating device 100 according to embodiment 3 illustrated in FIG. 3 is provided with a liquid level measuring unit 211, in addition to the configuration of embodiment 2. The same component reference numbers indicate the same functions, and components having additional functions will, in particular, be described.

The liquid level measuring unit 211 measures the amount of oxygen-enriched liquid in the bottom portion 21 of the nitrogen distillation column 2. The optimum rotational speed calculation command unit 9 restricts the rotational speed such that the liquid amount measured by the liquid level measuring unit 211 lies within a predetermined set range (upper limit value and lower limit value).

As a result, adjustments can be made to the rotational speed control of the booster expanders (6, 7) in accordance with the liquid level in the bottom portion 21 of the nitrogen distillation column 2. Enthalpy is released to the outside from process gas by means of a braking system, through a medium such as heat or electric power, and the process gas is cooled correspondingly. This is referred to as supplying coldness to the process gas. For a cryogenic air separating device such as the nitrogen generating device 100, it is important to obtain liquefied air as a reflux liquid, and to this end, a sufficient supply of coldness is essential. Since it is normally desirable to maintain a certain amount of liquefied air in the device in order to maintain the operation of the nitrogen generating device, a certain liquid level is maintained in a space in the bottom portion 21 of the nitrogen distillation column 2. Meanwhile, if the rotational speed control of the booster expander is changed in conjunction with a change in the pressure of the product nitrogen gas in the present embodiment, there is a concern that the coldness supplied to the process may be insufficient (when increasing the rotational speed, for example). Consequently, as in the present embodiment, a configuration is adopted in which an operation management liquid level is set in advance, and a deflection amplitude of a control rotation speed is limited to prevent deviation from the management range. By so doing, continuous operation of the device can be maintained without causing a shortage of coldness, even with respect to larger demand pressure changes.

Embodiment 4

Figure 4:
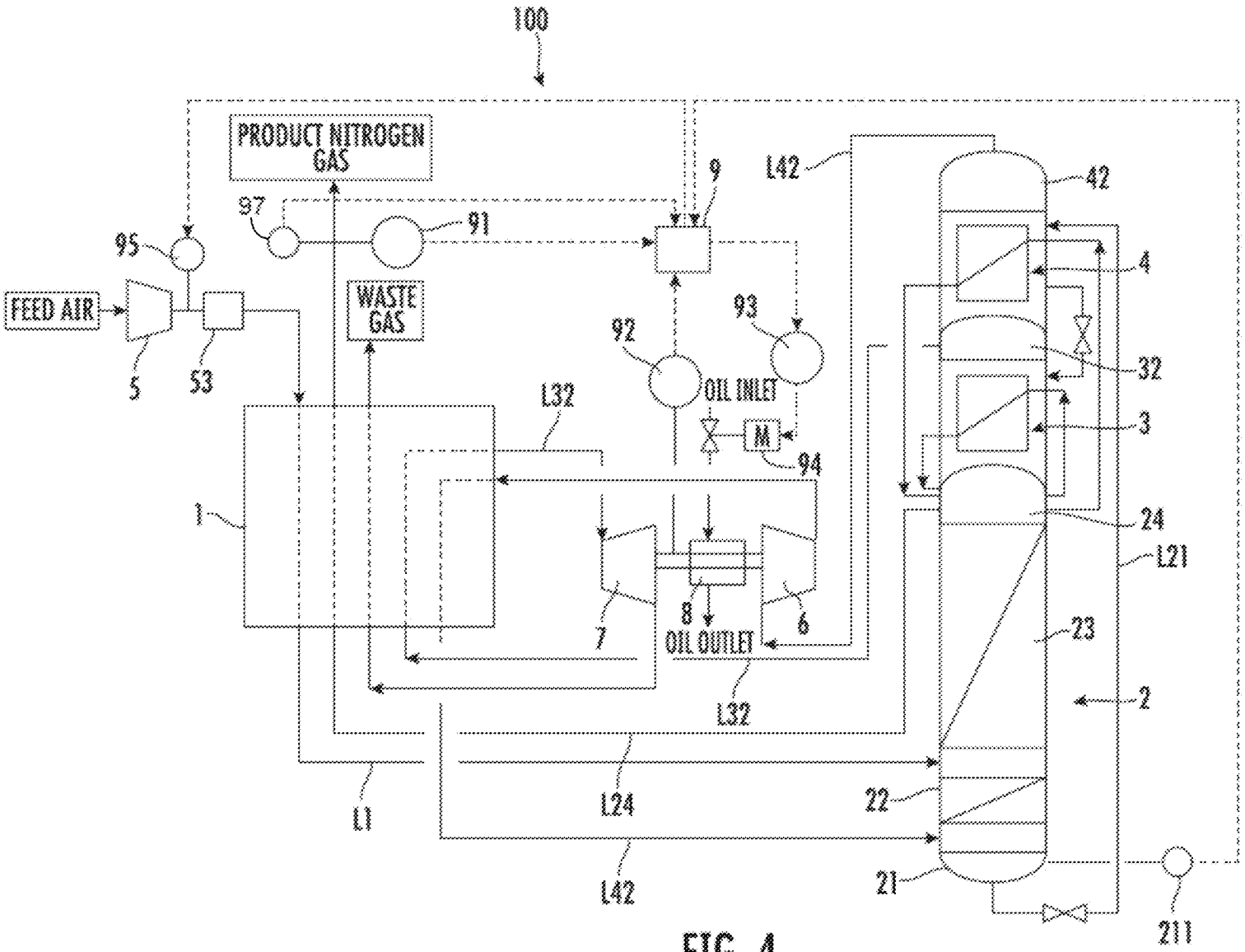
FIG. 4 is a configuration example of a nitrogen generating device (air separating device) according to embodiment 4.

The nitrogen generating device 100 according to embodiment 4 illustrated in FIG. 4 is provided with a flow rate measuring unit 97, in addition to the configuration of embodiment 3. The same component reference numbers indicate the same functions, and components having additional functions will, in particular, be described.

A pressure measuring unit 97 is provided on the downstream side of the main heat exchanger 1 in the product nitrogen gas extraction pipeline L24 to measure a flow rate value of the product nitrogen gas. The optimum rotational speed calculation command unit 9 adjusts the rotational speed obtained by the rotational speed calculation function in accordance with the flow rate measured by the flow rate measuring unit 97.

According to the present embodiment, the rotational speed can be adjusted in accordance with (in proportion to) the flow rate of the product nitrogen gas, with respect to the rotational speed obtained from the pressure of the product nitrogen gas.

The rotational speed set value obtained using the rotational speed calculation function is adjusted using the following formula (3).

$$y'=w\times Y \quad (3)$$

Rotational speed set value after adjustment: y'
Rotational speed set value: y (obtain using formula (1) above)
Coefficient: w (adjustment coefficient based on flow rate value of product nitrogen gas)

The coefficient w is set in advance from the results of simulations corresponding to the equipment specifications and from device implementation experiments.

The optimum rotational speed calculation command unit 9 and the feed air supply pressure control unit 95 may be implemented through a collaborative action between a computer provided with a processor and a memory, and a software program stored in the memory, or may be implemented using a dedicated circuit or firmware, for example, and may be provided with an input/output interface and an output unit.

Nitrogen Generating Method

The nitrogen generating method may employ the nitrogen generating device described hereinabove to generate nitrogen, or may be executed using other equipment.

In one embodiment, the nitrogen generating method according to the present disclosure is a method for generating nitrogen with at least a main heat exchanger, a nitrogen distillation column, at least one nitrogen condenser, a compressor, and an expansion turbine, the method including: a rotation control step for controlling rotation with respect to a rotating shaft connecting the compressor and the expansion turbine; a pressure measuring step for measuring a pressure value in an arbitrarily defined part of the nitrogen distillation column or measuring a pressure value of product nitrogen gas; and an optimum rotational speed calculation command step for using the pressure value measured in the pressure measuring step in a pre-installed rotational speed calculation function to calculate a rotational speed of the rotating shaft connecting the compressor and the expansion turbine, and for issuing a command for the rotation control step.

Feed air discharged from the main heat exchanger may be introduced into a lower portion of the nitrogen distillation column.

The nitrogen condenser may condense the nitrogen gas discharged from a column top portion of the nitrogen distillation column.

First gas discharged from the column top portion of the nitrogen condenser may be introduced into the compressor.

Second gas discharged from the column top portion of the nitrogen condenser may be introduced into the expansion turbine after passing through a portion of the main heat exchanger.

The rotation control step may be executed by means of a rotation control unit for controlling the rotation with respect to the rotating shaft connecting the compressor and the expansion turbine.

The pressure measuring step may be executed by means of a pressure measuring unit for measuring a pressure value in an arbitrarily defined part of the nitrogen distillation column or measuring a pressure value of the product nitrogen gas.

The optimum rotational speed calculation command step may be executed by means of an optimum rotational speed calculation command unit for using the pressure value measured by the pressure measuring unit in a pre-installed rotational speed calculation function to calculate the rotational speed of the rotating shaft, and for issuing a command to the rotation control unit.

A product nitrogen gas extraction pipeline may be a pipeline for causing the nitrogen gas discharged from the column top portion or an upper distillation portion of the nitrogen distillation column to pass through the main heat exchanger, and for then extracting product nitrogen gas.

A first gas recycling pipeline may cause the first gas compressed by the compressor to pass through a portion of the main heat exchanger and may introduce the same into the lower portion of the nitrogen distillation column.

A second gas discharge pipeline may be a pipeline for causing the second gas used by the expansion turbine to pass through the main heat exchanger and be expelled.

In the nitrogen generating method, in the optimum rotational speed calculation command step and/or the rotation control step, a rotational speed measured by a rotation measuring unit which measures the rotational speed of the rotating shaft may be controlled (feedback control) so as to become the rotational speed obtained by the rotational speed calculation function.

The nitrogen generating method may include a feed air supply pressure control step for controlling a discharge pressure set value of a feed air compressor for controlling the supply pressure of the feed air upstream of the main heat exchanger, on the basis of a demand pressure value of the product nitrogen gas or a pressure value measured in the pressure measuring step.

In the nitrogen generating method, in the optimum rotational speed calculation command step and/or the rotation control step, the rotational speed may be restricted such that a liquid amount measured by a liquid level measuring unit for measuring an amount of oxygen-enriched liquid in the bottom portion of the nitrogen distillation column lies within a predetermined set range (upper limit and lower limit values).

In the nitrogen generating method, in the optimum rotational speed calculation command step, the rotational speed obtained by the rotational speed calculation function may be adjusted in accordance with a flow rate measured by a flow rate measuring unit for measuring a flow rate value of the product nitrogen gas on the upstream side or the downstream side of the main heat exchanger.

Other Embodiments (1) The nitrogen generating device may be provided with a first distillation column (high pressure distillation column) for distilling liquefied air, and a second distillation column (low pressure distillation column) to which crude oxygen from which high boiling-point components (such as methane) have been removed is discharged from the high pressure distillation column for further distillation. The high pressure distillation column may be a nitrogen producing distillation column. Nitrogen can be extracted from the nitrogen producing distillation column. The low pressure distillation column may be an oxygen producing distillation column.

(2) In embodiments 1 to 4, the oil brake is used to adjust the rotational speed, but the present invention is not limited thereto, and the rotational speed may essentially be controlled by driving an electricity generator connected to the expansion turbine to recover electrical energy.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

LIST OF ELEMENTS

100 Nitrogen generating device (air separating device)
1 Main heat exchanger
2 Nitrogen distillation column
3 First condenser
4 Second condenser
Feed air compressor
6 Compressor
7 Expansion turbine
8 Rotation control unit (oil brake)
9 Optimum rotational speed calculation command unit
91 Feed air compressor
93 Air cleaning device
95 Feed air supply pressure control unit
97 Flow rate measuring unit
211 Liquid level measuring unit
L21 Circulating pipeline
L24 Product nitrogen gas extraction pipeline
L32 Second gas discharge pipeline
L42 First gas recycling pipeline

What is claimed is:

1. A nitrogen generating device comprising:

a main heat exchanger into which feed air is introduced;

a nitrogen distillation column having a lower portion into which the feed air discharged from the main heat exchanger is introduced;

a first nitrogen condenser configured to condense a first nitrogen gas discharged from a column top portion of the nitrogen distillation column;

a second nitrogen condenser configured to condense a second nitrogen gas discharged from the column top portion of the nitrogen distillation column;

a compressor in fluid communication with a top portion of the first nitrogen condenser, wherein the compressor is configured to receive a first gas discharged from the top portion of the first nitrogen condenser;

a first gas recycling pipeline configured to cause the first gas compressed by the compressor to pass through a portion of the main heat exchanger and configured to introduce the same into the lower portion of the nitrogen distillation column;

an expansion turbine into which a second gas discharged from a top portion of the second nitrogen condenser is introduced after passing through a portion of the main heat exchanger;

a second gas discharge pipeline configured to cause the second gas used by the expansion turbine to pass through the main heat exchanger and be expelled;

a rotation control unit configured to control rotation with respect to a rotating shaft connecting the compressor and the expansion turbine;

a product nitrogen gas extraction pipeline configured to cause a product nitrogen gas discharged from the column top portion or an upper distillation portion of the nitrogen distillation column to pass through the main heat exchanger, and further configured to extract the product nitrogen gas from the main heat exchanger;

a pressure measuring unit configured to measure a pressure value in an arbitrarily defined part of the nitrogen distillation column or to measure a pressure value of the product nitrogen gas; and an optimum rotational speed calculation command unit configured to use the pressure value measured by the pressure measuring unit in a pre-installed rotational speed calculation function to calculate a rotational speed of the rotating shaft, and configured to issue a command to the rotation control unit.

2. The nitrogen generating device as claimed in claim 1, further provided with: a feed air compressor configured to control a supply pressure of the feed air upstream of the main heat exchanger; and a feed air supply pressure control unit configured to control a discharge pressure set value of the feed air compressor on a basis of a demand pressure value of the product nitrogen gas or a pressure value measured by the pressure measuring unit.

3. The nitrogen generating device as claimed in claim 1, wherein a liquid level measuring unit for measuring an amount of oxygen-enriched liquid in a bottom portion of the nitrogen distillation column, and the optimum rotational speed calculation command unit and/or the rotation control unit may restrict the rotational speed such that a liquid amount measured by the liquid level measuring unit lies within a predetermined set range.

4. The nitrogen generating device as claimed in claim 1, further provided with a flow rate measuring unit which is provided on an upstream side or a downstream side of the main heat exchanger in the product nitrogen gas extraction pipeline to measure a flow rate value of the product nitrogen gas, wherein the optimum rotational speed calculation command unit adjusts the rotational speed obtained by the rotational speed calculation function in accordance with the flow rate measured by the flow rate measuring unit.

5. The nitrogen generating device as claimed in claim 1, further comprising a rotation measuring unit (92) configured to directly measure the rotational speed of the rotating shaft, and wherein the optimum rotational speed calculation command unit (9) and/or the rotation control unit (8) is further configured to utilize the rotational speed measured by the rotation measuring unit (92) as feedback to control the rotational speed of the rotating shaft.

6. The nitrogen generating device as claimed in claim 1, wherein the pre-installed rotational speed calculation function defines a linear relationship between the rotational speed (y) to be calculated and the measured pressure value (x).

7. The nitrogen generating device as claimed in claim 1, wherein the pre-installed rotational speed calculation function defines a non-linear polynomial relationship between the rotational speed (y) to be calculated and the measured pressure value (x).

* * * * *